United States Patent [19]

Lambert, III

[11] Patent Number: 4,584,572

[45] Date of Patent: Apr. 22, 1986

[54] VIDEO SYSTEM

[75] Inventor: Lester T. Lambert, III, Garden Grove, Calif.

[73] Assignee: Electro-Sport, Inc., Costa Mesa, Calif.

[21] Appl. No.: 387,597

[22] Filed: Jun. 11, 1982

[51] Int. Cl.[4] ..... G09G 1/28

[52] U.S. Cl. ..... 340/703; 340/728; 340/741

[58] Field of Search ..... 340/703, 701, 709, 728, 340/747, 721

[56] References Cited

U.S. PATENT DOCUMENTS

| | | | |
|---|---|---|---|
| 3,573,789 | 4/1971 | Sharp | 340/728 |
| 3,789,386 | 1/1974 | Itoh | 340/728 |
| 3,878,536 | 4/1975 | Gilliam | 340/728 |
| 3,911,418 | 10/1975 | Takeda | 340/703 |
| 4,023,165 | 5/1977 | Holt et al. | 340/728 |
| 4,028,695 | 6/1977 | Saich | 340/709 |
| 4,233,601 | 11/1980 | Hankins et al. | 340/703 |
| 4,303,986 | 12/1981 | Lans | 340/709 |
| 4,345,313 | 8/1982 | Knox | 340/709 |

OTHER PUBLICATIONS

*Video Display Processor Simulates Three Dimensions,* Guttag et al.; Electronics; vol. 53, No. 25; 11/80, pp. 123–126.

*Primary Examiner*—Marshall M. Curtis
*Attorney, Agent, or Firm*—Grover A. Frater

[57] ABSTRACT

The invention provides a method of controlling the color of the individual pixels of a digital display with appearance information formed by color information and position information. Each set of color information is applicable to a pair of adjacent pixels, but the position signal may cause the color signal of one pair of pixels to control the color of one pixel of the adjacent pair. Apparatus for practicing the invention includes a storage means capable of storing two sets of appearance information at the same time and for selecting one set of information or the other for application to the display.

6 Claims, 7 Drawing Figures

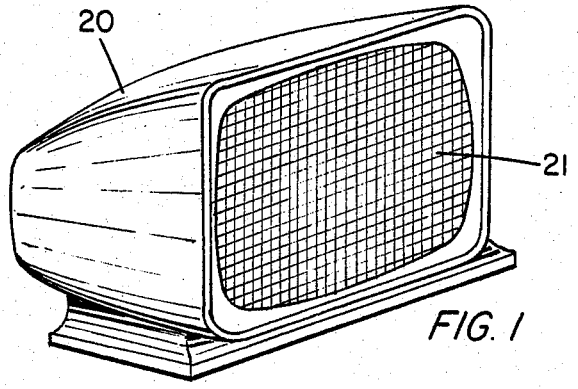
FIG. 1
FIG 2
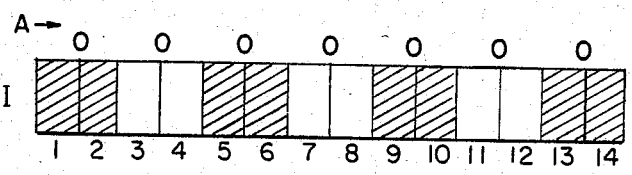
FIG. 3
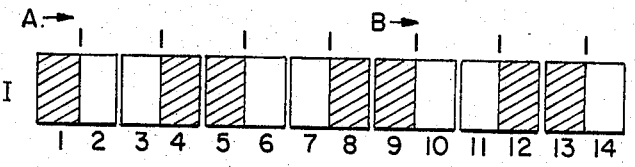
FIG. 4
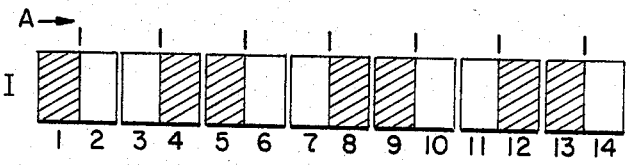
FIG. 5
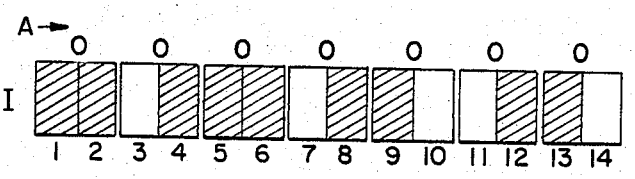
FIG. 6
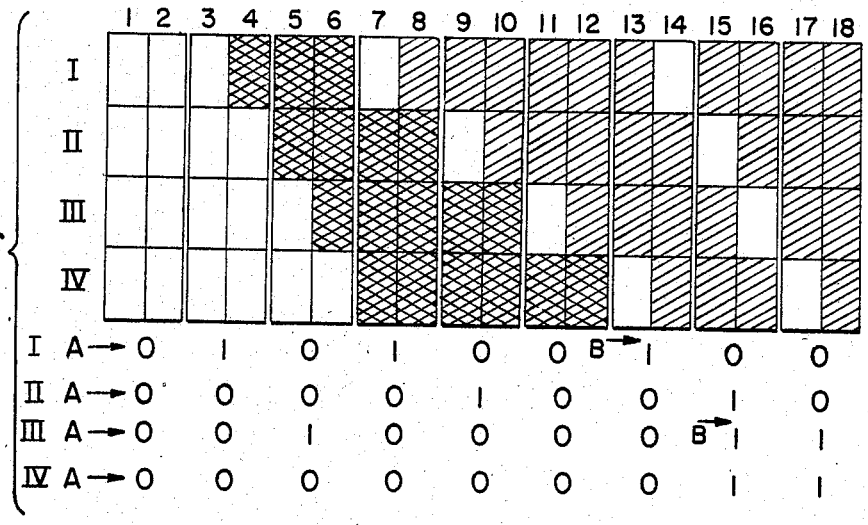

VIDEO SYSTEM

TECHNICAL FIELD

This invention relates to improvements in video systems, and it relates in particular to methods and apparatus for achieving greater resolution in digitized video displays for a given amount of video information.

BACKGROUND ART

In most video displays in which the display is changeable, the picture pixels are arranged in rows and columns. The invention is applicable to any display of that kind whether it be a cathode ray tube display or a newer grid LED or liquid crystal or color grid display, or any other including the old electric light bulb displays. Currently, the advantages of the invention are most apparent when it is applied to cathode ray color tube displays.

A pixel is defined as the smallest area of a digital display screen all of which must have the same color where the term "color" means color value or hue or shade. The term implies that the color of an individual pixel may and can have a color different from that of any pixel adjacent to it in a display.

In most cases the color or range of colors that can be displayed on the screen of a given display apparatus is determined by that apparatus. Control of what colors are displayed within that range can be accomplished with a wide variety of digital devices the more practical forms of which are electronic in nature. The color, cathode ray picture tube creates images by sweeping a beam across the face of the tube where it excites chemicals on the face to visible phospheresence. The beam sweeps across the tube face again and again on adjacent parallel straight paths to form a raster over the entire screen. In one convention, the raster is formed by 528 horizontal, closely spaced parallel straight lines, and the raster is formed thirty times per second. On such a screen a pixel is an area formed by a length of at least one line of the raster. Because the rate at which the beam moves across the screen is usually uniform, the time to trace a line is fixed.

Accordingly, the width of a pixel can be defined as a time—some fraction of the time required to sweep a line. The height of a pixel can be defined in terms of number of sweep lines. In one standard, the display is divided into pixels such that each pixel is one line high, and such that there are 536 across the width of the screen. In that standard, a "character" is eight pixels high and eight pixels long.

To create an image in different hues on the screen of a color picture tube, it is required to energize the three guns of the tube in different relative degree. To color one pixel of the screen requires that the tube guns be energized to produce the desired color each time that the beams of those guns trace through that one pixel for the time that the beam is traversing the width of the pixel. To do that requires timing information for use in ensuring that the selected pixel is the one that is colored, and it requires color information to ensure that the pixel is given the selected color. Color information must be supplied for each pixel. When it must be supplied is a matter of timing, controlled by the clock which controls raster generation, or by a separate clock that is synchronized with the raster control clock.

In the case of a black and white display, only one bit of information is required for each pixel to specify whether it is to be colored black or white. Three bits of information will specify any of eight colors and that number is common in many applications.

In some applications, all of the color information bits are generated by a computer. That might be true in the case of graphical solution of mathematical equations. In other applications, as for example in interactive computerized teaching and in video games, much of the color information is stored in memory devices to be fetched by a computer, or otherwise. In many cases, for example in the case of video games that involve many different characters or playing pieces, enough information must be stored so that the cost of memory devices is relatively high. In the past, the only relief from cost was to sacrifice resolution by reducing the number of pixels or, in some cases, by reducing the number of characters.

DISCLOSURE OF INVENTION

It is an object of the invention to reduce the amount of information that must be stored to achieve a given degree of resolution in a video display. As a corollary, it is an object to achieve higher resolution in a digital video display at little or no increase in cost or storage requirement.

To accomplish those objectives the invention makes each set of color information applicable to a pair (or more) of adjacent pixels, and it adds position information which defines whether that same information is applicable to one of the pixels or to adJacent pairs of pixels.

In the preferred form of the invention at least two sets of color and position information are stored for use in defining the color in at least two adjacent pairs of adjacent pixels in a line of pixels. One of those two sets of color information is used to establish the color of the two pixels of a first one of said pairs. The other set of color information is used to establish the color of the second one of said two pairs. The position information is used to alter that simple relationship by causing the color information applicable to one pair of pixels to control the color of that pixel of the other pair which is adjacent in time and position to that one pair of pixels.

It is a feature of the invention that position signals can make the color information applicable to a given pair of pixels apply to a pixel in a pair which leads or follows the given pair. A change from effect of the leading pixel pair, or the lagging pixel pair, can be made at the beginning of any pair of pixels.

If, in a given embodiment, the position information is used only to alter the color of a pixel in one or the other of the adjacent pairs of pixels, it is usually preferred to use the position signal to alter the color of a pixel in a preceding pair of pixels.

Apparatus for accomplishing the invention includes a means for storing two sets of color information, and a means for applying that information to create colors in the display that extends over four pixels, and a means for determining in a limited sense which pixels will have their color controlled by which set of color information.

The invention embraces refinements of that apparatus and, in addition, it provides, and it is an object to provide, a novel system for highlighting pixels of the display.

BRIEF DESCRIPTION OF THE DRAWINGS

In the drawings:

FIG. 1 is an isometric view of a color video monitor whose screen is divided into lines and columns to represent pixel areas;

FIG. 2 is a symbolic representation of a series of pixels of a display to be used as a reference in the explanation of the invention;

FIG. 3 is a symbolic representation of how color of the pixels of FIG. 2 can be modified in the invention by the addition of position information and mode information;

FIG. 4 is a symbolic representation of how the color of the pixels of FIG. 3 are modified by the addition of mode information;

FIG. 5 is a symbolic representation of how the color of the pixels of FIG. 3 are modified by position change without mode change;

FIG. 6 is a symbolic representation of the pixels of several lines of a display showing how the color and position and mode information is used to generate lines and color boundaries.

DESCRIPTION OF PREFERRED EMBODIMENT

Figure 7:
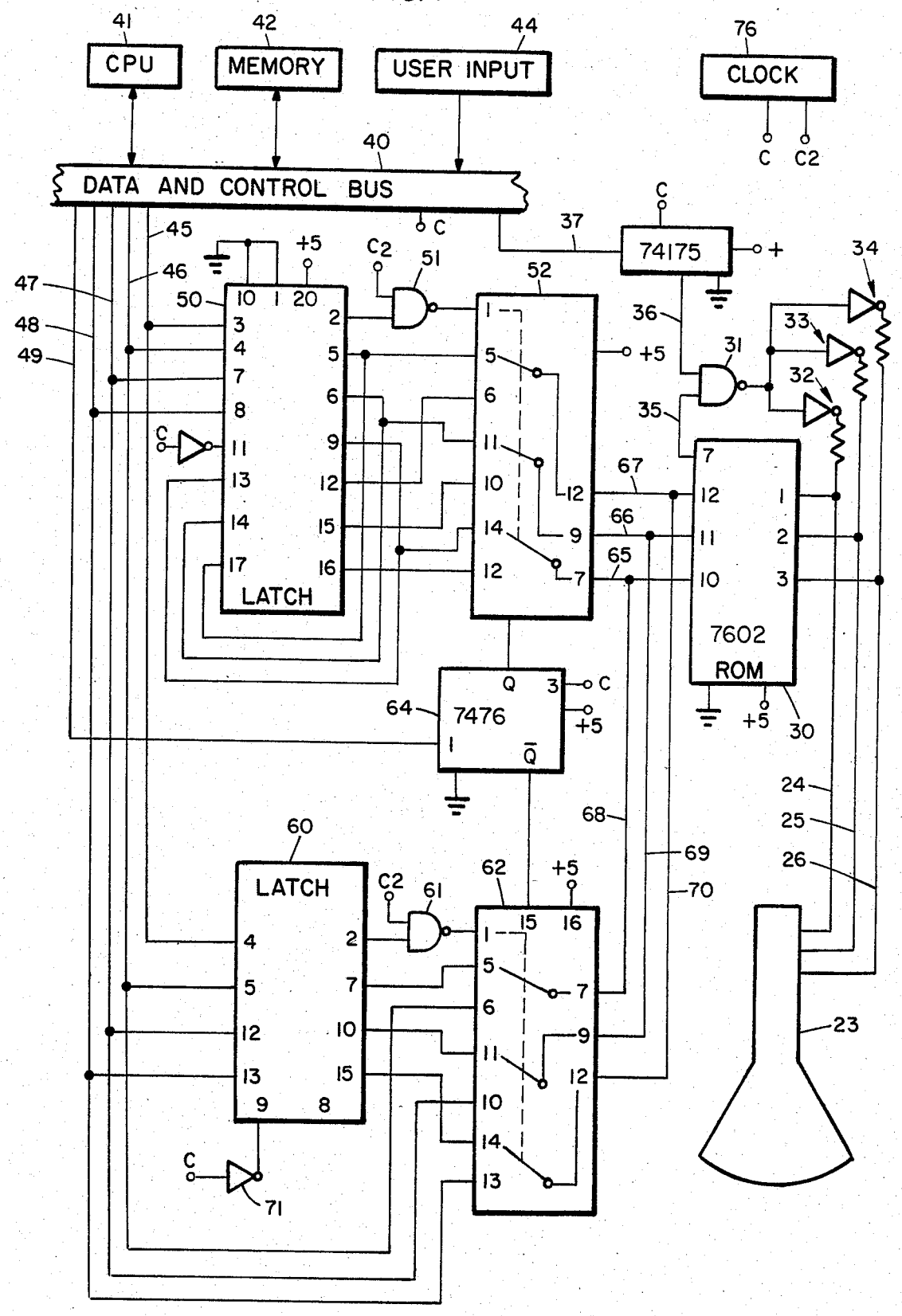
FIG. 7 is a schematic diagram of a preferred apparatus for practicing the invention.

The video monitor unit 20 of FIG. 1 has its screen 21 divided by a series of spaced horizontal lines and spaced vertical lines to form a grid of rows and columns. That representation is symbolic. In practice, the video display screen of this monitor, or any other form of digital display unit, would not be marked with a visible grid of lines. The grid has been shown to illustrate that the display area can be considered and treated as being divided into rows and columns of small areas between the lines. The smallest area of a video display which, in any given application, cannot be subdivided by color hue or value or shade is called a pixel. If the apparatus or program or other means by which video pictures are formed on screen 21 is capable of forming a different color in the different rectangular areas bounded by the screen's horizontal and vertical lines but cannot form other than a uniform color over any of these areas, then each area is a pixel.

In this case the monitor 20 houses a color picture tube of the kind that employs three separate guns to form colored images on the face of the tube which is screen 21. The monitor includes a means for causing the tube's electron beam to form a raster of 528 lines. Internal clock circuits make it possible to change color along any line 536 times. The circuitry that controls color is arranged such that the color along any vertical line across the display must be the same over one horizontal line of the display. Thus, in this case, the display is 528 pixels high, and it is 536 pixels wide. The number of pixels or degree of resolution is limited in this case, not by the tube's capabilities but by the system and apparatus which causes the display to be formed. One object of the invention is to achieve this or any other degree of resolution with a less costly system and apparatus.

In the example selected for description, the video display is created one horizontal row of pixels at a time, beginning at the top of the screen. That is not essential, but it conforms to convention. Because each pixel can have a different color by definition, separate color information is required for each pixel. If some pixels are to have the same color as others, their color information will be the same. Ordinarily, in that case a single set of color information is referred to in creating the color of the pixels that are to have the same color. In a video game, for example, that displays moveable figures or objects that can be moved over a colored background, or one that displays a representation of playing cards or the like, the color pattern that forms the figure or object or the playing card and its "spots" can be represented by a quantity of color information which can be stored in and recalled from a memory device.

To minimize the amount of memory that is required, the invention colors pixels in pairs arranged sequentially in time along the line in which they occur.

The invention makes the initial assumption that both pixels of a pair will be colored the same. If that is not true in the case of the pixels of any pair, the color of one pixel of the pair can be changed to the color of the pixels of the preceding or succeeding pair of pixels. In a simple form, the color of only the last in time of the pixels of a pair can be changed to conform to the color of the succeeding pair of pixels. Alternatively, the color of only the first in time of the pixels of a pair can be changed to conform to the color of the preceding pair of pixels. A combination of those techniques permits changing the color of either pixel of a pair to conform to the color of an adjacent pair of pixels.

FIGS. 2 through 6 illustrate the effect of the application of these techniques. FIG. 2 shows a succession or series of pixels taken from a line of pixels in display 21. They have been taken from line I and those taken were part of vertical pixel columns 1 through 14 of the display. The column 1 and 2 pixels form a pair, the column 3 and 4 pixels form another pair, and so on such that pixels 1 through 14 form seven pairs. What is shown in FIG. 2 will be used as a reference display. Only two colors are displayed—white and grey. Both pixels of each pair have the same color and adjacent pairs of pixels are differently colored. The pairs 1-2 and 5-6 and 9-10 and 13-14 are grey. The intervening pairs are colored white. In practice, the colors grey and white might be other colors. Red, for example, or blue or shades of grey. Eight colors or shades of colors including shades of grey can be specified one at a time by three bits of information. Because the pixels of a pair are the same color, only three color bits are needed to specify the color of a pixel pair in an eight color option application. Another bit of information is added in the invention, and it is called a position bit. Together, the color information and the position information are called appearance information, and the position bit or bits and the color bits, however many there are for one pair of pixels, are called a set of appearance information.

Let it be assumed, according to convention, that the information that resides in a bit is designated 0 or 1 and that one of these, assume 0, means that both pixels of the pair with which the position bit is associated will have the same color. In FIG. 2, the 0 above each pair of pixels is the value of the position bit for that pair.

In the invention, a means is provided for changing the color of one pixel of a pair to the color of the adjacent pair. In this example, the signal for doing that is to change the position bit to a 1. That has been done in the case of each pair of pixels in FIG. 3. To permit easier identification of the pairs, they are separated slightly in FIGS. 3, 4, 5 and 6, but in an actual display, they would not be separated. In FIG. 3, the pixels are the same as those of FIG. 2, shown at a time when the position bit signal of each pair is a 1. In the pixel pair 1-2, the color of pixel 1 is unchanged, but pixel 2 is colored to correspond to the color of the next pixel pair 3-4. Since the position bit of the next pair 3-4 is also a 1, the second pixel 4 of that pair is colored to correspond to the color of the next pair 5-6. Because the position bit is 1 at each pair, the effect is to shift the color pattern 1 pixel left.

The mode symbol A in the several figures indicates that the 1 code specifies that the second pixel of the pixel pair is altered and that its color is determined by the color code of the pair of pixels that follows in time. The mode symbol B designates an arrangement in which the color of a pixel whose color is to be altered is determined by the color information associated with the preceding pair of pixels. The effect of changing from mode A to mode B operation is depicted in FIG. 3 on the same line I of pixels assuming that the position code is 1 for each pair of the series. Color is shifted left or earlier in time during mode A operation, and it is shifted right or later in time beginning at pixel pair 9-10 where mode B operation begins.

FIG. 5 depicts the same series of line I pixels in the case in which the position code is changed without a change in mode. Comparison of FIGS. 4 and 5 shows that it is possible to form color patterns one pixel wide in the invention by change in mode and by change in position code. Provision of mode B requires another bit in the set of appearance information. But five bits permits the same degree of resolution in almost every instance as does the six bits per two pixels in a conventional eight color display system. The difference in a four bit mode A or a four bit mode B eight color capability and that of a five bit two mode, eight color system is depicted in FIG. 6.

Four series of pixels, 1 through 18, taken from adjacent pixel lines I, II, III and IV is shown in FIG. 6. A schedule of position bit values and modes is shown for each pair of pixels and each line immediately below the pixel diagram. Three colors—white, cross-hatched and double hatched, are displayed. Only mode A is employed in pixels 1 through 6 to separate two color areas, white and double hatched, along a line whose slope is defined as a one pixel shift per line. One-half that slope is achieved in pixels 7 through 13 when tracing a single pixel line between two colors. The slope of the line can be doubled by combining mode B and mode A operation.

In most applications the ability to form a line one pixel wide is far less important than the ability to form a sharp and relatively smooth transition from one color area to another in the horizontal direction. The invention will do that in either mode A or mode B alone with four bits in an eight color system compared to six bits to perform the same task in a conventional system. Whether the appearance information is computer generated or simply fetched from memory, the result is a saving in system component cost, and size, approaching one-third.

A preferred form of apparatus for practicing the invention is shown in FIG. 7. It was selected for illustration because the invention is particularly useful in the circumstance in which a computer and user inputs generate display appearance information for application to a color tube, and because the invention embraces that kind of an arrangement. What FIG. 7 depicts could be a computer game, an interactive teaching machine, the display portion of a flight simulator, or have any other of a wide variety of applications.

In FIG. 7, the color display tube 23 is part of a conventional video monitor. It has three guns which act in consort to create the image the color, and intensity, of which is determined by signals on gun excitation lines 24, 25 and 26 at the right in FIG. 7. These lines connect to pins 1, 2 and 3, respectively, of a type 7602 read only memory 30. Highlighting capability is added by the inclusion of a NAND gate 31 whose output is connected by three inverter and decoupling resistor combinations 32, 33 and 34 to lines 24, 25 and 26 respectively. The gate inputs are connected one by line 35 to pin 7 of ROM 30 and the other by a line 36 to the output of a "D" memory switch which, in this case, is one section of a quad memory unit 74175. The other sections are used for blanking and other conventional functions and which form no part of the invention. The input line 37 of the highlighting section connects to the computer bus 40.

The computer bus 40 includes the data lines and control lines that interconnect the central processing unit, CPU, 41, the memory 42, user input device 44 with one another and with the several lines 45, 46, 47, 48 and 49. The memory unit 42 represents both the random access memory and the read only memory of the system. It is the requirement for this memory, and particularly it is the read only portion, the ROM portion, which it is an object of the invention to minimize.

The system shown is arranged to operate in both the A and B modes described above. Latch 50 and NAND gate 51 and multiplexer 52 in the upper half of the diagram are devoted to mode B operation in which the display is shifted to the right. In the lower half of FIG. 7 latch 70, NAND gate 61 and multiplexer 62 are devoted to mode A operation. Other arrangements are possible. This one is preferred because in those applications in which only one mode is required, the latch and multiplexer integrated circuits of one mode are simply not installed in the circuit.

The multiplexers are type 74LS257 integrated circuits which serve as a three pole double-throw switch actuated by a signal on pin 1 and whose pole pin 7, 9 and 12 may be open circuited by signal voltages at pin 15. Pin 15 of each of multiplexer 52 is connected to the Q output and pin 15 of multiplexer 62 is connected to the NOT Q output of a type 7476 flip-flop 64. Accordingly, the output of one multiplexer or the other is open circuited and the other output at pins 7, 9 and 12 are connected by lines 65, 66 and 67, respectively in the case of multiplexer 52, and by lines 68, 69 and 70, respectively in the case of multiplexer 62 to pins 10, 11 and 12 of the 7602 ROM 30. Operation of the flip-flop 64 to select A or B mode is controlled by signals on mode line 49 which extends to bus 40.

Color information appears on lines 46, 47 and 48 and is stored in latches 50 and 60 along with position information which appears on line 45.

Latch 50 stores one set of color information. It is an integrated circuit type 74LS175. Clock signals are applied to its pin 9 through an inverter 71. Color lines 46, 47 and 48 are connected to pins 5, 12 and 13, respectively. The inputs are clocked into the latch and are available at output pins 7, 10 and 15 which connect to input pins 5, 11 and 14, respectively, of multiplex 62. Color lines 46, 47 and 48 are also connected directly to multiplexer 62 pins 6, 10 and 13, respectively. If the multiplexer 62 "switches" are in the position shown in the drawing, the latched color signals at latch 60 pins 7, 10 and 15 appear at multiplexer 62 pins 7, 9 and 12. However, if the multiplexer 62 "switches" are thrown to the opposite position, the multiplexer output pins 7, 9 and 12 will be connected directly to color lines 46, 47 and 48, respectively.

System timing by the clock 76 is such that each set of position and color information is applied to lines 45 through 48 for the time required for the tube 23 beam to sweep through the width of two pixels. What appears on lines 46, 47 and 48 is the latest color information. What appears at the output of latch 60 is the previous set of information. However, latching aids in control of system timing, so to apply the latched signal to the 7602 ROM 30 is the "normal" method. Accordingly, the output of the latch is considered to be current color information, and the information on lines 46, 47 and 48 is considered to be the next future or subsequent color information. Which is applied to the 7602 color ROM 30 is determined by the "switch" position in multiplex 62 and the switch position is determined by the output condition of NAND gate 61.

Gate 61 has two inputs one a clock input C2 offset by one-half time interval (the interval representing one pixel width) from clock signal C. The other input is the position bit signal which was delivered by line 45 to latch input pin 4 from which it was latched to output pin 2 of latch 60. If the signal on line 45 was a 1 so that a 1 is clocked to latch 60 output pin 2, the switch in multiplex 62 will be "thrown" when signal C2 goes high at the time of beginning of the second pixel of a pair. When that occurs, the multiplexer outputs are connected to lines 46, 47 and 48 instead of the latch outputs and the current second pixel of the pair is colored in the way that the next pixel pair is scheduled to be colored.

The mode B apparatus includes latch 50, which in this case is an integrated circuit type 74LS364, the NAND gate 51 and multiplexer 52. The latter is another type 74LS257 unit. The connection of the multiplexer output terminals 7, 9 and 12 to lines 65, 66 and 67 and input terminals 10, 11 and 12 to color ROM 30 has already been described. The input terminals 5, 11 and 14 of the multiplexer are connected to multiplexer output terminals 12, 9 and 7, respectively when the multiplexer "switches" are in the condition indicated in the drawing.

Input terminals 5, 11 and 14 of multiplexer 52 are also connected to output terminals 5, 6 and 9 of latch 50 to receive the color signals which are latched to terminals 5, 6 and 9 from latch input terminals 4, 7 and 8, respectively. Those input terminals are connected to color information lines 46, 47 and 48, respectively, whereby the color input signals that are applied to color ROM 30 normal, mode B operation are the current signals that have been latched through the latch 50 one time.

Input terminals 13, 14 and 17 of latch 50 are connected to output terminals 9, 6 and 5, respectively of the same latch 50. Signals at input terminals 13, 14 and 17 are latched to latch 50 output terminals 12, 15 and 16, respectively. Those terminals are to input terminals 6, 10 and 13, respectively, of multiplexer 52.

Because the input to latch terminals 13, 14 and 17 has already been latched through the latch once, the output at latch terminals 12, 15 and 16 is twice latched. Thus, the color information at multiplexer terminals 5, 11 and 14 is current color information and the color information at multiplexer terminals 6, 10 and 13 is previous color information. Current or previous information is selected for application to the input of color ROM. 30 at the multiplexer 52 by "switching" and the switching is controlled by gate 51. If gate output at multiplexer pin 1 is a zero, current information is selected, but if the gate output is a one, previous information is selected to shift the display color one pixel to the right.

Gate 51 is controlled in the same way that gate 61 is controlled. One gate input is connected to the C2 clock signal and the other input is connected to pin 2 of latch 50.

The color ROM 7602 is a standard device whose function is to connect input color signals into output signals suitable for controlling the operation of a three gun color tube.

Although I have shown and described certain specific embodiments of my invention, I am fully aware that many modifications thereof are possible. My invention, therefore, is not to be restricted except insofar as is necessitated by the prior art.

I claim:

1. The method of enhancing resolution in video displays the display area of which is divided into a plurality of series of four pixels arranged in series as a first pair and a second pair of pixels;

storing first and second sets of information respectively associated with said first and second pairs of pixels, each set comprising color information and position information and position information, the position information designating whether the pixel adjacent the pair of pixels associated with the other of said sets of information is to be colored in accordance with the color information in said first set or said second set of information; and coloring each pixel according to the color information in the set of information associated with the pair of pixels of which it is a part unless the position information in the other set of information designates that it be colored in accordance with the color information in said other set of information in which case it is colored in accordance with the color information in said other set of information.

2. The method of creating a display formed by a series of pairs of adjacent pixels which method comprises the steps of:

assigning a color to each pair of pixels;

selectively specifying an alternative color for selected ones of said pixels to conform to the color assigned to the pair of pixels adjacent to each of said selected ones of said pixels, respectively; and coloring said pairs of pixels in order with colors conforming to the color assigned to each pair of pixels except that each of said selected ones of said pixels is colored to conform to the color specified for the pair of pixels adjacent to it in the series, respectively.

3. The method of providing information for enhancing resolution in video displays the display area of which is divided into pixels arranged in series in pairs, which method comprises the steps of:

storing for each pixel pair in a series of pairs, color information defining a color;

storing position information defining whether the color information of one of the pixel pairs adjacent to another pixel pair is to be used to alter the color of one of the pixels of that other pair to conform to the color information stored for said one of the pixel pairs;

utilizing said stored information to control the pixels of said display.

4. The method of providing information for enhancing resolution invideo displays the display area of which is divided into pixels arranged in series in pairs and the pairs in series, which method comprises the steps of:

storing for each pixel pair in a series of pairs, color information defining a color;

storing position information defining whether the color information of an adjacent pixel pair is to be used to alter the color of one of the pixels of that pair to conform to the color information applicble to said adjacent pair; and further comprising the step of storing, for each pixel pair whose position information defines that the color of one of its pixels is to correspond to the color information applicable to an adjacent pixel pair, information defining whether the adjacent pixel pair is to be the succeeding or the preceding pair.

5. Apparatus for enhancing resolution in video displays in which pixels are arranged in series in pairs, comprising, in combination:

means for storing color information assigning a color to each pair of pixels of the series and for storing information specifying which pairs of pixels are to have the color of one pixel of the pair selectively alterred to conform to the color assigned to the pair of pixels adjacent to said one pixel in the series; and means for coloring said pixels in accordance with said selective alteration or said assignment, respectively.

6. The invention defined in claim 5 which further comprises means for storing information defining whether said selective alteration of color is to be made to conform to the color assigned to the preceding or to the color assigned to the succeeding pair of pixels.

* * * * *